United States Patent [19]

van der Hoeff

[11] Patent Number: 4,913,649

[45] Date of Patent: Apr. 3, 1990

[54] REPAIR OF THE REFRACTORY LINING OF THE WALL OF A SHAFT FURNACE AND A REPAIRED SHAFT FURNACE

[75] Inventor: Joseph A. M. van der Hoeff, Limmen, Netherlands

[73] Assignee: Hoogovens Groep B.V., Ijmuiden, Netherlands

[21] Appl. No.: 275,507

[22] Filed: Nov. 23, 1988

[30] Foreign Application Priority Data

Dec. 2, 1987 [NL] Netherlands ..... 8702891

[51] Int. Cl.[4] ..... F27D 1/14

[52] U.S. Cl. ..... 432/3; 266/281; 432/76; 432/95

[58] Field of Search ..... 432/3, 76, 95; 266/281

[56] References Cited

U.S. PATENT DOCUMENTS

| | | | |
|---|---|---|---|
| 1,996,266 | 4/1935 | Willetts | 432/3 |
| 4,155,703 | 5/1979 | Mantey et al. | 432/3 |
| 4,607,994 | 8/1986 | Jacobsson | 266/281 |
| 4,765,789 | 8/1988 | Lonardi et al. | 266/281 |

FOREIGN PATENT DOCUMENTS 1530030 10/1978 United Kingdom .

OTHER PUBLICATIONS

Patent Abstracts of Japan, vol. 11, No. 101(C-413)(2548) 3/31/87, "Method for Repairing Blast Furnace Wall", S. Takada.

Patent Abstracts of Japan, vol. 7, No. 232(C-190)(1377) 10/14/83, "Method for Relining Wall of Blast Furnace", S. Kataoka.

*Primary Examiner*—Henry C. Yuen

*Attorney, Agent, or Firm*—Stevens, Davis, Miller & Mosher

[57] ABSTRACT

In the repair of a refractory lining of a shaft furnace having a steel shell, a worn residual refractory lining inside the shell and cooling plates extending through the shell into the refractory lining, the worn lining is retained and an additional lining structure is added by (a) forming a refractory concrete layer with a flat upper surface at a ring of said cooling plates, (b) building up on the flat upper surface a refractory brickwork of blocks which is self-supporting and which has recesses in which cooling plates are located with clearance, the blocks being selected in accordance with the amount of wear locally, (c) filling space between the brickwork and the residual lining with concrete, and (d) filling the clearance space between the brickwork and the cooling plates in the recesses with a thermally conductive rammed mass.

13 Claims, 1 Drawing Sheet

REPAIR OF THE REFRACTORY LINING OF THE WALL OF A SHAFT FURNACE AND A REPAIRED SHAFT FURNACE

BACKGROUND OF THE INVENTION

1. Field of the Invention

The invention relates to a method for the repair of the refractory lining of the wall of a shaft furnace, which has a steel shell, a worn residual refractory lining and cooling plates for coolant flow extending through the shell into the refractory lining. The method will be described and illustrated in particular with reference to an application in a blast furnace for preparing pig iron, but the invention is equally applicable to other shaft furnaces of the type indicated. The invention extends to a shaft furnace repaired by the method.

2. Description of the Prior Art

A common design for a blast furnace is of the type described above. In such a furnace the service life of the refractory wall lining is extended by cooling the lining by means of the cooling plates with water flowing through them. These cooling plates generally have a flat shape, so that as well as their cooling function they also have the function of anchoring the brickwork. The cooling plates are in horizontal rings. The spacing of the plates in these rings, and the vertical spacing of the rings, is here referred to as the pitch of the cooling plate pattern.

During the campaign of a blast furnace which may last many years, the lining is subject to continuous corrosion and erosion, whereby the protection of the shell by this lining is steadily lessened. At the end of a campaign the residual lining may have a very erratic profile and in places may even have almost disappeared entirely. The furnace is taken out of service and provided with a new lining.

The most radical repair consists in that the entire residual lining is removed and an original new lining is fitted. This has various drawbacks. Since the refractory lining is often made from expensive materials, in some places for example from graphite, semi-graphite or silicon carbide, the removal of the residual lining means a considerable capital loss. Fitting a new lining also takes a long time, since in particular it must be built up completely from bricks and blocks shaped to fit. Some of these shapes may only be made when, after the furnace has cooled down, the exact dimensions of the furnace can be measured. It will be clear that fitting an entirely new lining is not only expensive, but moreover is associated with much wasted time representing considerable loss of production by the furnace.

Proposals are known for achieving interim repairs to furnaces by injecting or compacting mass onto the places where the lining is the most worn, but it has been found that such repairs have only limited durability and that in the course of time more radical repairs are still needed.

SUMMARY OF THE INVENTION

The object of the invention is to provide a method of repair which at least partly avoids the disadvantages described above and by which the time and/or cost of replacing or repairing a furnace lining are reduced. By the invention, a significant part of the residual lining is kept and a very durable lining is obtained which may be fitted in a very short time. The applicant's experiences indicate that a repair carried out in accordance with the method of the invention can have durability comparable with that of an entirely new lining.

The invention consists in a method for the repair of a refractory lining of a wall of a shaft furnace, the wall having a steel shell, a worn residual refractory lining inside the shell and cooling plates which in use have coolant flowing through them and which extend through the shell into the refractory lining in a pattern of horizontal rings of regular pitch vertically and circumferentially, the method being characterized by the following steps:

(a) forming a refractory concrete layer at a first said ring (*4a*) of said cooling plates upwardly from which the repair is to be carried out and forming a flat upper surface of said concrete layer, (b) building up on said flat upper surface a refractory brickwork which is self-supporting and which has recesses in which said cooling plates in rings above said first ring are located with clearance, said brickwork being made of refractory blocks whose dimensions in the direction transverse to the shell are selected in dependence on the amount of wear locally of the residual lining, (c) filling space between said brickwork and said residual lining with concrete, (d) after step (c), filling the clearance space between the brickwork and the cooling plates in said recesses with a thermally conductive rammed mass.

Since the refractory brickwork is self-supporting, and the recesses in this brickwork for the cooling plates are thus also self-supporting, a very stable lining is obtained. This lining does not hang from or stick to the residual lining and/or the cooling plates, but is in fact anchored thereto by means of the rammed mass. Furthermore, a good bond and good thermal contact with the residual lining is obtained by means of the concrete inserted between the blocks and the residual lining.

The better the block dimensions are shaped to fit the residual lining, the less can be the amount of concrete and its thickness. This too encourages the thermal contact between old and new lining parts.

The setting of a lowest ring of cooling plates in a refractory concrete which concrete layer has its upper surface made flat is needed to obtain a good flat foundation on top of which the self-supporting structure is then built. By making this concrete layer as a continuous ring in the wall, the weight of the built up brickwork is spread around the circumference, and the cooling plates set in this way are not loaded too heavily.

In order to obtain a good self-supporting structure, it is recommended that in said step (b), over at least part of the furnace wall, those of said refractory blocks which are used vertically between successive horizontal rings of the cooling plates have a dimension in the circumferential direction of the wall which approximately corresponds to half the horizontal pitch of the cooling plates in said horizontal rings. This bridges over the recesses for the cooling plates in a simple self-supporting way. Furthermore, those of said refractory blocks located circumferentially between the cooling plates of said horizontal rings have a circumferential size which is a little less than the space between adjacent cooling plates of the horizontal ring. The more these blocks fill in the space between adjacent cooling plates, the less rammed mass is required. Too tight a fit might however hinder ramming of the mass later.

In modern furnaces, the width of the cooling plates often corresponds approximately with the width of the spaces between the cooling plates. If the present method is applied in such a furnace, then it is possible and recommendable to give uniform dimensions to the blocks in height and in width (in circumferential direction). This makes it easy to keep a prepared stock of a limited range of blocks for repairs, which enables very fast repairing. It will be clear that the length of the blocks (i.e. measured in radial direction of the furnace) depends on the extent of wear of the lining. Nevertheless, it is still possible to build up reasonably well fitting brickwork on the residual lining with a limited number of these lengths.

Maintaining a uniform width dimension for the blocks produces the least problems with a cylindrical furnace wall. However, large wall parts of furnaces run somewhat conically. In that case it will be difficult to maintain a uniform width, because the blocks cannot be fitted to complete the ring of a course at all heights. Nevertheless, it is found that it is not necessary to use a unique width of block for each course, where a wall part is conical. Preferably in the invention, in said step (b) in said conical part the blocks used vertically between successive horizontal rings of the cooling plates are of two dimensional formats, the blocks for each horizontal course being selected from said two formats so as to form a complete circumferential course of appropriate length.

Naturally this selection of the blocks must be done in such way that all recesses are well bridged over within the self-supporting brickwork.

If the foundation surface upon which the refractory brickwork is built up is properly flat, and furthermore if the blocks have a good uniform height dimension which has a simple relation with the vertical pitch of the cooling plates, then in principle the brickwork may be built up for an indefinite height. In practice, however, it is found that inaccuracies in maintaining height dimensions may occur, for example as a result of a distortion of the shell during operation or a twisting of cooling plates. So in order to obtain a good relative positioning of the recesses in the brickwork and of the cooling plates, it may be found to be necessary to make height corrections, for example by using thinner or thicker blocks. However, in order to limit differences in dimensions of the blocks as much as possible. e.g. after a number of courses of blocks have been layed, preferably pairs of blocks are used as the blocks placed circumferentially between the cooling plates of a horizontal ring of the cooling plates, each such pair consisting of superimposed blocks which are wedge-shaped and taper in respectively opposite directions. These wedge-shaped blocks may have fixed dimensions, but by mutual sliding of two blocks which make up one pair the desired total height is obtained.

The invention is especially well applicable if it is possible to have available large blocks of the dimensions required and of good accurate size. It is found that, to this end, it is preferable to use for the blocks a material which consists for at least 50% of graphite. Particularly, the best results are obtained with blocks which consist substantially entirely of graphite. The manufacture of blocks from graphite with very accurate dimensioning is known.

So that the cooling plates may conduct the heat away from the brickwork well, good heat conduction through the rammed mass is required. For this the rammed mass used should preferably have a thermal conductivity coefficient of at least 15 W/m.K and preferably of approximately 20 W/m.K. Such masses based on graphite are known and are available commercially.

When a blast furnace which has been repaired is brought back into service, it is found that the lining is subjected to extra heavy mechanical and thermal loading in the initial phase. In order not to subject the expensive brickwork to premature wear unnecessarily during that period, it may be useful to cover up that brickwork with a protective layer of concrete on the fire side. Applying sprayed concrete is in itself a known method. In this respect, it has been found that a good adhesion of this protective layer is achieved, so that it can remain in place longer, if it receives support from the brickwork. This may be achieved in the invention if some of the blocks are fitted to extend further into the furnace than the general face of the brickwork, so that they act as anchor or support the protective layer.

The invention does not relate only to the method for the repair of a shaft furnace, but also it relates to a shaft furnace of the type with a steel shell, a refractory lining inside the shell and cooling plates which in use have liquid flowing through them and which extend through the shell into the lining in a pattern of regular pitch, characterized in that said lining consists of a worn residual lining from earlier use of the furnace and a repair lining which has been applied in accordance with the method described above.

BRIEF INTRODUCTION OF THE DRAWINGS

An embodiment of the invention will be described below by way of non-limitative example with reference to the accompanying drawing, in which:

FIG. 1 shows schematically a cross section through a part of a repaired wall of a shaft furnace embodying the invention, and FIG. 2 is a side view of a part of the repaired wall of FIG. 1.

DESCRIPTION OF THE PREFERRED EMBODIMENT

Figure 1:
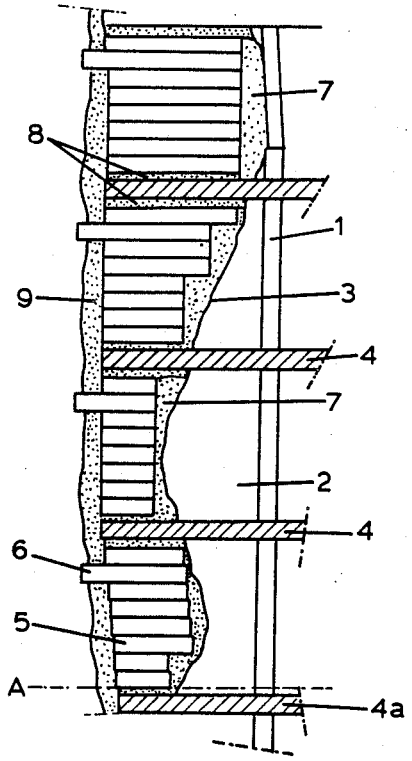

FIG. 1 shows a steel shell 1 of a blast furnace wall with an amount of residual lining 2 still present on it. The boundary 3 of this residual lining 2 shows clearly the erratic course of the thickness of this residual lining, which remains from a previous campaign of the furnace.

Figure 2:
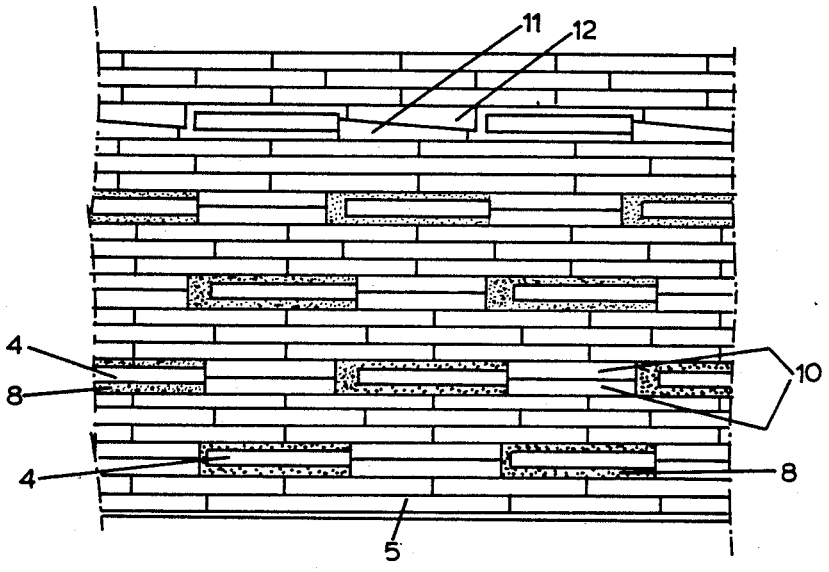

Cooling plates 4 are fitted with a fixed pitch over the height of the wall. These cooling plates are shown schematically, and they are of the known type with cooling water flowing through them. FIG. 2 shows the regular distribution of the cooling plates not only in the vertical direction but also in the circumferential direction over the wall.

Starting from the residual lining, the repair of the invention is carried out as follows. A lowest ring of the cooling plates 4*a* (FIG. 1), upwardly from which the repair is carried out, is first set in a refractory concrete, which is then rendered flat at a plane A at its upper surface. Plane surface A then serves as a foundation for building up a brickwork of blocks 5. This brickwork is self-supporting, i.e. it does not require support from the residual lining 2 or the cooling plates 4 above the lowest ring 4*a*, while it is being built. It contains recesses where the cooling plates project inwardly, which recesses receive the plates with clearance. Some of these blocks 6 project further into the furnace than the general inner face of the brickwork.

The vertical thickness of these blocks is constant, while as FIG. 2 shows the width of the blocks 5 is also constant where the furnace wall is cylindrical. Two blocks 5 have a total width corresponding to the pitch with which the cooling plates 4 are spaced circumferentially.

The length of the blocks 5, that is in the direction transverse to shell 1, is selected at each place to match to the profile 3 of the residual lining 2, so that the thickness of the brickwork 5 varies with the thickness of the residual lining. This may be achieved satisfactorily with blocks of a limited number of fixed length dimensions. The width of the blocks 10 in horizontal direction between adjacent cooling plates in each ring of cooling plates, is matched to the space between the plates. In the case described, the width of the cooling plates is approximately equal to half the pitch, so that blocks 10 may also have approximately the same dimension as the other blocks in courses vertically between the cooling plate rings.

If the wall 1 extends slightly conically, then it is found that blocks of two width dimensions are sufficient for building up the brickwork. One basic block format is matched to the largest diameter of the conical portion of the furnace and the other to the smallest diameter. By combination of the two basic formats it is then possible to fit the blocks to complete a course at any place up the height.

As the drawing shows, by giving the blocks large width dimensions it is possible to bridge over in a self-supporting way the recesses into which cooling plates 4 extend. The clearance space between the cooling plates 4 and the brickwork is then rammed full with a graphite mass 8 for which, for example, a commercially available so-called HCB rammed mass, marketed by the firm Marshall, may be used. Between blocks 5 and the profile surface 3 of the residual lining a refractory concrete 7 is poured in.

FIG. 2 shows pairs of wedge-shaped blocks 11,12 by which it is possible to make local corrections in the height of the brickwork courses. The two blocks 11,12 of each pair are superimposed between two adjacent cooling plates, with their tapers directed in opposite circumferential directions. By choice of the relative positions of the two blocks 11,12 a desired total height can be obtained.

After completion of the brickwork 5 and insertion of the rammed mass 8, a protective concrete layer 9 is sprayed onto the inside (fire) face of the brickwork. This layer 9 is anchored to and supported by the inwardly projecting blocks 5. In FIG. 2 this layer 9 is omitted.

What is claimed is:

1. Method for the repair of a refractory lining of a wall of a shaft furnace, the wall having a steel shell, a worn residual refractory lining inside the shell and cooling plates which in use have coolant flowing through them and which extend through the shell into the refractory lining in a pattern of horizontal rings of regular pitch vertically and circumferentially, the method being characterized by the following steps:

(a) forming a refractory concrete layer at a first said ring (4*a*) of said cooling plates upwardly from which the repair is to be carried out and forming a flat upper surface of said concrete layer, (b) building up on said flat upper surface a refractory brickwork which is self-supporting and which has recesses in which said cooling plates in rings above said first ring are located with clearance, said brickwork being made of refractory blocks whose dimensions in the direction transverse to the shell are selected in dependence on the amount of wear locally of the residual lining, (c) filling space between said brickwork and said residual lining with concrete, (d) after step (c), filling the clearance space between the brickwork and the cooling plates in said recesses with a thermally conductive rammed mass.

2. Method according to claim 1 wherein, in step (b), over at least part of the furnace wall, those of said refractory blocks which are used vertically between successive horizontal rings of the cooling plates have a dimension in the circumferential direction of the wall which approximately corresponds to half the horizontal pitch of the cooling plates in said horizontal rings, and those of said refractory blocks located circumferentially between the cooling plates of said horizontal rings have a circumferential size which is a little less than the space between adjacent cooling plates of the horizontal ring.

3. Method according to claim 2 wherein in said horizontal rings of the cooling plates the circumferential width of each cooling plate is approximately equal to the width of the circumferential gap between adjacent cooling plates, and the refractory blocks used in and vertically between said horizontal rings have uniform dimensions in the vertical and circumferential directions.

4. Method according to claim 2 wherein a part of the furnace wall being repaired is generally conical and in said step (b) in said conical part the blocks used vertically between successive horizontal rings of the cooling plates are of two dimensional formats, the blocks for each horizontal course being selected from said two formats so as to form a complete circumferential course of appropriate length.

5. Method according to claim 1 wherein in said step (b), to achieve variation of height of at least one horizontal course of the blocks, pairs of blocks are used as the blocks placed circumferentially between the cooling plates of a horizontal ring of the cooling plates, each such pair consisting of superimposed blocks which are wedge-shaped and taper in respectively opposite directions.

6. Method according to claim 1 wherein said blocks are made of a material which is at least 50% graphite by weight.

7. Method according to claim 6 wherein the material of said blocks consists substantially entirely of graphite.

8. Method according to claim 1 wherein said rammed mass has a thermal conductivity coefficient of at least 15 W/m.K.

9. Method according to claim 8 wherein said rammed mass contains graphite.

10. Method according to claim 1 further including the step of spraying a protective layer of concrete onto the fire-side face of the refractory brickwork.

11. Method according to claim 10 wherein in said step (b) in said refractory brickwork, said blocks are arranged to project into the furnace relative to the general fire-side face of said brickwork, so as to provide support for said protective layer of concrete.

12. Shaft furnace having a steel shell, a refractory lining inside said shell and cooling plates which in use have coolant flowing through them and which extend through the shell into the refractory lining in a pattern of horizontal rings of regular pitch horizontally and vertically, said refractory lining comprising a worn residual lining from earlier use of the furnace and a repair lining which comprises (a) a refractory concrete layer at a first said ring of said cooling plates, said concrete layer having a flat upper surface, (b) a self-supporting refractory brickwork built up on said flat upper surface and having recesses which receive, with clearance, said cooling plates of rings thereof above said first ring, said brickwork being made of refractory blocks, (c) concrete filling at least partly a space between said refractory brickwork and said residual lining, (d) ramming mass filling the clearance space in said recesses between the refractory brickwork and the cooling plates therein.

13. A shaft furnace according to claim 12 further having on the inside face of said refractory lining a protective layer of concrete.

* * * * *